US008326175B2

(12) United States Patent
Sueoka

(10) Patent No.: US 8,326,175 B2
(45) Date of Patent: Dec. 4, 2012

(54) IMAGE FORMING APPARATUS

(75) Inventor: Takenori Sueoka, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 12/902,455

(22) Filed: Oct. 12, 2010

(65) Prior Publication Data

US 2011/0097104 A1 Apr. 28, 2011

(30) Foreign Application Priority Data

Oct. 22, 2009 (JP) ..... 2009-243172

(51) Int. Cl.
*G03G 15/16* (2006.01)

(52) U.S. Cl. ..... 399/101

(58) Field of Classification Search ..... 399/101, 399/99, 349, 350
See application file for complete search history.

(56) References Cited

U.S. PATENT DOCUMENTS 5,450,185 A * 9/1995 Kuribayashi et al. ..... 399/350
5,646,718 A * 7/1997 Suwa et al. ..... 399/350
5,774,765 A 6/1998 Hirota et al.
5,881,339 A * 3/1999 Yanagida et al. ..... 399/101
6,473,589 B2 * 10/2002 Hisakuni ..... 399/350
6,640,081 B2 * 10/2003 Sato ..... 399/350
7,697,879 B2 * 4/2010 Watanabe et al. ..... 399/350
7,764,917 B2 * 7/2010 Ueno ..... 399/350
2007/0201898 A1 * 8/2007 Mochizuki ..... 399/101

FOREIGN PATENT DOCUMENTS

JP 9-134102 A 5/1997
JP 2003-248401 A 9/2003
JP 2005-77820 A 3/2005
JP 2008-224726 A 9/2008

* cited by examiner

*Primary Examiner* — Susan Lee
(74) *Attorney, Agent, or Firm* — Fitzpatrick, Cella, Harper & Scinto

(57) ABSTRACT

An image forming apparatus, including: a rotatable image bearing member; a developer carrying member configured to carry a developer to form a developer image on the image bearing member; a cleaning blade configured to remove the developer remaining on the image bearing member; a conveying unit configured to convey the developer removed by the cleaning blade, toward a developer recovering portion; and a cleaning auxiliary portion configured to move the developer accumulated on the cleaning blade toward the conveying unit, the cleaning auxiliary portion having a length that is smaller, in a rotation axial direction of the image bearing member, than a developer width of the developer carried by the developer carrying member.

14 Claims, 11 Drawing Sheets

FIG. 4A WITHOUT CLEANING AUXILIARY MEMBER
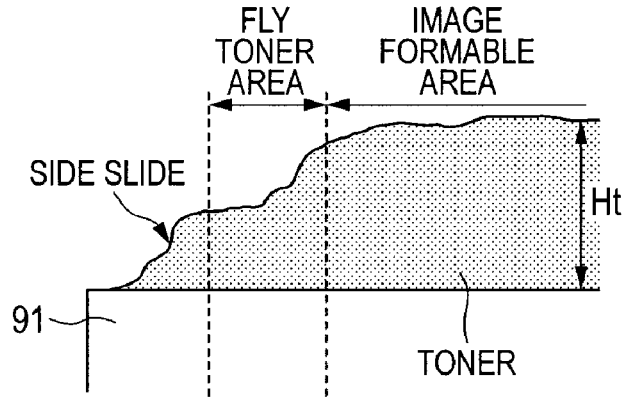
FIG. 4B WITH CLEANING AUXILIARY MEMBER EXTENDING THE ENTIRE LENGTH
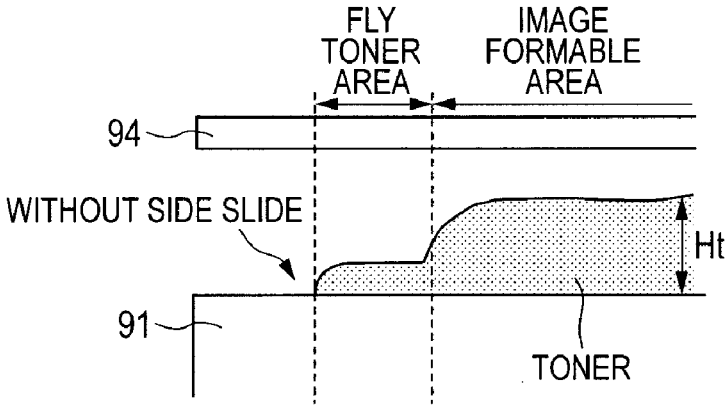
FIG. 4C WITH SHIFTED SHORT CLEANING AUXILIARY MEMBER
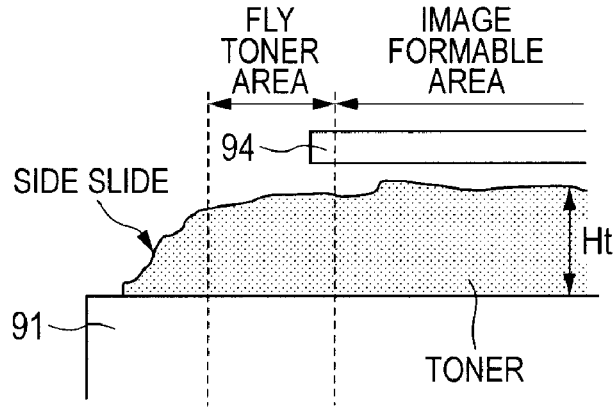

IMAGE FORMING APPARATUS

BACKGROUND OF THE INVENTION

1. Field of the Invention

The present invention relates to an image forming apparatus, in which a cleaning blade is used to recover toner from an image bearing member, and more particularly, to a configuration structure of a cleaning auxiliary member which prevents excessive accumulation of toner on the cleaning blade.

2. Description of the Related Art

There is widely used an image forming apparatus in which a toner image formed on a photosensitive member is transferred, directly or through an intermediate transfer member, to a recording material to be thermally fixed. The image forming apparatus is provided with a cleaning device for recovering unnecessary toner from an image bearing member (a photosensitive member, an intermediate transfer member, a recording material conveying member, or a transfer roller) by using a cleaning blade.

In the cleaning device using the cleaning blade, when toner is excessively accumulated on the cleaning blade, the toner interferes with the operation of the cleaning blade, which impairs normal cleaning performance of the cleaning device. That is, an excessive pressure may be exerted on a distal edge of the cleaning blade, which may result in fusion bonding of the toner. And, the cleaning blade may be thermally deformed, which may result in slipping-out of the toner.

In recent years, along with the downsizing of the image forming apparatus, the cleaning device is reduced in capacity. On the other hand, the processing speed of image formation is becoming increasingly higher. As a result, when image formation with the use of a large amount of toner is successively performed, a toner accumulation rapidly builds up to be coagulated on the cleaning blade in a portion where the cleaning blade is rubbed against the image formable area of the image bearing member, which easily leads to the above-mentioned problems.

Japanese Patent Application Laid-Open No. 2008-224726 discloses a cleaning device in which the cleaning blade knocks off toner recovered from the photosensitive drum into a conveying screw so that the toner may be carried to a one end side of the photosensitive drum for recovery. The cleaning device includes an agitating member formed of a bent rod, which comes into contact with a conveying screw and intermittently vibrates, to thereby break down coagulated toner adhering to the conveying screw by the agitating member.

Japanese Patent Application Laid-Open No. 2003-248401 discloses a cleaning device which includes a wire tensioned along a distal edge of the cleaning blade. In the cleaning device, the wire vibrates in a longitudinal direction, with the result that toner coagulated on the distal edge of the cleaning blade is broken down and falls off.

In order to allow the cleaning blade to provide stable cleaning performance when the image forming apparatus is operated at a high processing speed, the cleaning blade may desirably have toner accumulated to an appropriate amount on the distal edge thereof so that a trace amount of toner may always be supplied to the rubbing portion. If no toner is supplied, the cleaning blade may generate a chatter vibration, or may be thermally deformed, which increases slipping-out of toner.

However, as illustrated in FIG. 5, in the image forming apparatus, a cleaning blade (91) needs to be disposed to extend outward beyond each of fly toner areas outside the image formable area of an image bearing member (51) for performing cleaning. Here, no toner image is formed outside the image formable area, and fly toner does not reach the outside of each of the fly toner areas. As a result, sufficient toner may not be supplied to the cleaning blade (91) in a part on an end thereof.

However, in practice, toner scraped off in the image formable area and in the fly toner areas flows along the distal edge of the cleaning blade (91) to diffusely move outward, with the result that toner is supplied all the way to the end of the cleaning blade (91).

As illustrated in FIG. 4A, toner accumulated on the cleaning blade (91) forms an accumulation distribution in which the toner accumulation amount reduces outward toward the end of the cleaning blade. Accordingly, toner flowing along the distal edge of the cleaning blade (91) side-slides outward in a manner of flattening the gradient of the accumulation distribution.

However, in a configuration including a cleaning auxiliary member (94) as illustrated in FIG. 4B, the cleaning auxiliary member (94) removes toner accumulated on the cleaning blade (91) too early, and the outward movement of toner along the distal edge of the cleaning blade (91) tends to become discontinuous. The cleaning auxiliary member (94) uniformly removes toner accumulated on the image formable area and on the fly toner areas, and hence the accumulation distribution for moving the toner outward toward the end of the cleaning blade (91) cannot be formed, which fails, as a result, a mechanism for causing toner flowing along the distal edge of the cleaning blade (91) to be driven by the gradient of the accumulation distribution to diffusely move outward.

SUMMARY OF THE INVENTION

It is an object of the present invention to provide an image forming apparatus capable of increasing stability in cleaning.

It is another object of the present invention to provide an image forming apparatus, including: a rotatable image bearing member; a developer carrying member configured to carry a developer to form a developer image on the image bearing member; a cleaning blade configured to remove the developer remaining on the image bearing member; a conveying unit configured to convey the developer removed by the cleaning blade, toward a developer recovering portion; and a cleaning auxiliary portion configured to move the developer accumulated on the cleaning blade toward the conveying unit, the cleaning auxiliary portion having a length that is smaller, in a rotation axial direction of the image bearing member, than a developer width of the developer carried by the developer carrying member.

Further features of the present invention will become apparent from the following description of exemplary embodiments with reference to the attached drawings.

BRIEF DESCRIPTION OF THE DRAWINGS

FIGS. 4A, 4B, and 4C are explanatory diagrams for illustrating toner accumulation distributions on a cleaning blade in a fly toner area.

DESCRIPTION OF THE EMBODIMENT

In the following, an embodiment of the present invention will be described in detail, with reference to the accompanying drawings. The present invention may be implemented by another embodiment in which the configuration of this embodiment is replaced in part or entirely with an alternative configuration thereof, as long as a cleaning auxiliary member is shorter than a cleaning blade and disposed closer to the center with respect to the cleaning blade.

An image bearing member, against which the cleaning blade is rubbed, may be any one of a photosensitive member, an intermediate transfer member, and a recording material conveying member. The present invention may be implemented irrespective of whether the image forming apparatus is of full-color, monochrome, tandem-type, or single-drum type. In this embodiment, only a main portion that relates to formation and transfer of a toner image will be described. However, additional necessary devices, equipment, and a casing may be provided so that the present invention may be applied to various uses such as a printer, various printing machines, a copying machine, a facsimile machine, a complex machine, and the like.

<Image Forming Apparatus>

Figure 1:
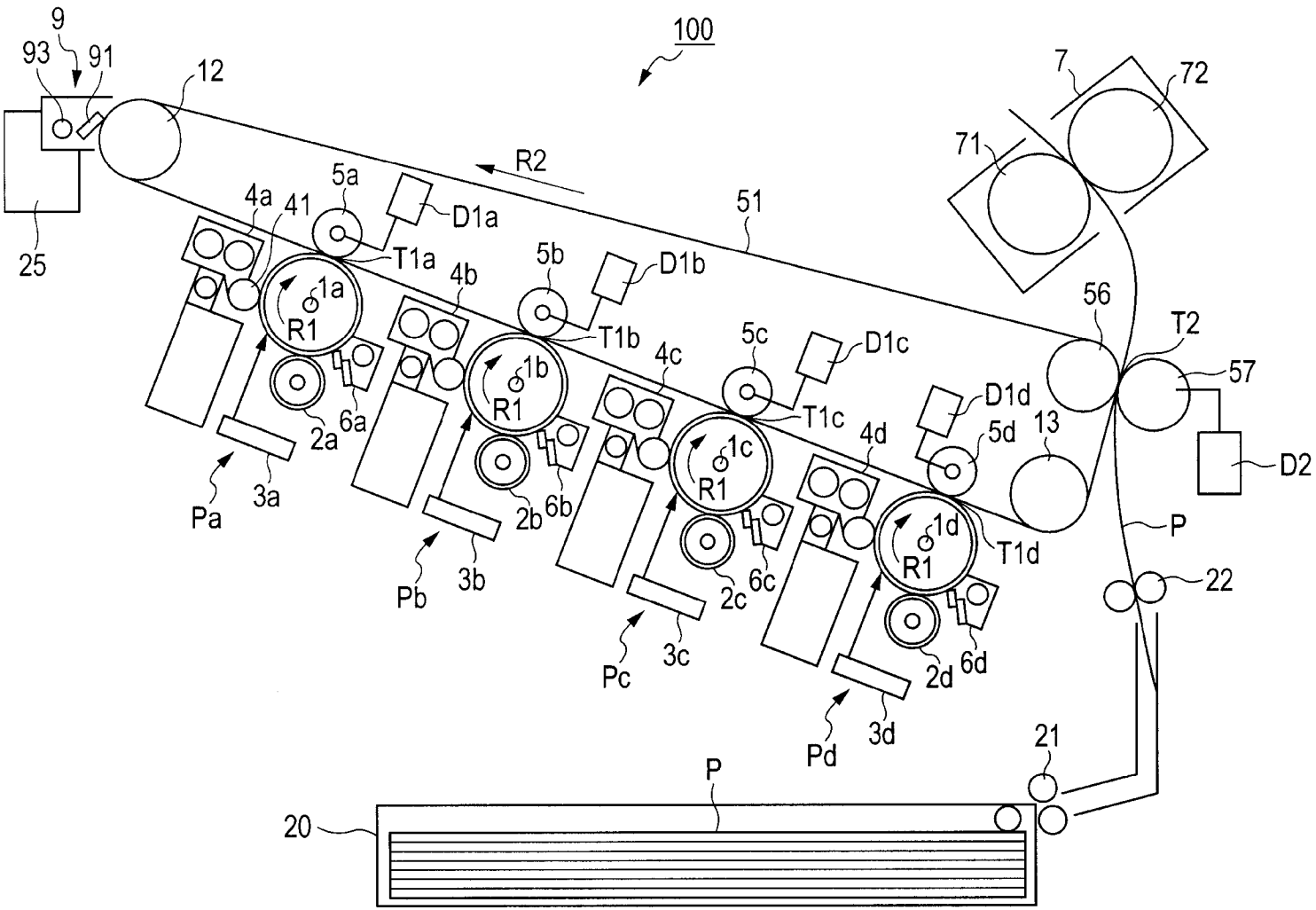
FIG. 1 is an explanatory diagram for illustrating a configuration of an image forming apparatus according to an embodiment of the present invention.

FIG. 1 is an explanatory diagram of a configuration of the image forming apparatus according to the embodiment of the present invention.

As illustrated in FIG. 1, an image forming apparatus 100 is a tandem-type full-color printer which includes image forming portions Pa, Pb, Pc, and Pd of yellow, magenta, cyan, and black, which are disposed along an intermediate transfer belt 51.

In the image forming portion Pa, a yellow toner image is formed on a photosensitive drum 1*a*, and the yellow toner image is primarily transferred onto the intermediate transfer belt 51. In the image forming portion Pb, a magenta toner image is formed on a photosensitive drum 1*b*, and the magenta toner image is primarily transferred to be superimposed on the yellow toner image on the intermediate transfer belt 51. In the image forming portions Pc and Pd, a cyan toner image and a black toner image are formed on the photosensitive drums 1*c* and 1*d*, respectively, and the cyan toner image and the black toner image are primarily transferred sequentially to be superimposed on the yellow and magenta toner images on the intermediate transfer belt 51 in a similar manner.

The four-color toner image borne on the intermediate transfer belt 51 is secondarily transferred in a collective manner onto a recording material P in a secondary transfer portion T2. The recording material P, onto which the four-color toner image is secondarily transferred in the secondary transfer portion T2, is subjected to heat and pressure in a fixing device 7 so that the toner image is fixed on a surface thereof, and then delivered outside the apparatus main body.

The image forming portions Pa, Pb, Pc, and Pd are configured similarly to one another, except that the colors of toner used in developing devices 4*a*, 4*b*, 4*c*, and 4*d* are different as yellow, magenta, cyan, and black. Accordingly, in the following, the image forming portion Pa of yellow will be described. Similar references are used to designate similar components in the image forming portions Pb, Pc, and Pd of the other colors, with the suffix letters "b", "c", and "d" being added to the references.

The image forming portion Pa includes a charging roller 2*a*, an exposure device 3*a*, the developing device 4*a*, a primary transfer roller 5*a*, and a cleaning device 6*a*, which are disposed around the photosensitive drum 1*a*. The photosensitive drum 1*a* is formed of an aluminum cylinder having an outer diameter of 30 mm, which has a negative chargeable photosensitive layer formed on the outer peripheral surface thereof. The photosensitive drum 1*a* rotates in a direction indicated by an arrow R1 at a processing speed of 135 mm/sec.

The charging roller 2*a* is applied with a vibrating voltage obtained by superimposing an alternating-current (AC) voltage on a direct-current (DC) voltage, to thereby charge a surface of the photosensitive drum 1*a* to a uniform negative potential (about −650 V in this embodiment). The exposure device 3*a* scans the charged surface of the photosensitive drum 1*a* through a polygon mirror with a laser beam obtained by ON-OFF modulation of scanning line image data developed from image data, to thereby write an electrostatic image for an image to be formed on the charged surface of the photosensitive drum 1*a*.

The developing device 4*a* agitates and circulates a two-component developer to charge toner (non-magnetic) serving as a developer to a negative polarity and a carrier (magnetic) to a positive polarity. The two-component developer thus charged is magnetically carried by a developing sleeve 41 serving as a developer carrying member, and forms a magnetic brush, to thereby rub against the photosensitive drum 1*a*. A power supply (not shown) applies a vibrating voltage obtained by superimposing an AC voltage on a DC voltage of negative polarity to the developing sleeve 41, and hence toner is transferred from the developing sleeve 41 to the photosensitive drum 1*a*, to thereby reversely develop the electrostatic image. The vibrating voltage is formed of, for example, a DC voltage of −400 V and an AC voltage of 1.5 kVpp, and has a rectangular waveform of a frequency of 3 kHz.

The primary transfer roller 5*a* presses an inner surface of the intermediate transfer belt 51 with a predetermined pressing force, to thereby form a primary transfer portion T1*a* for a toner image between the photosensitive drum 1*a* and the intermediate transfer belt 51. A power supply D1*a* applies a DC voltage of positive polarity, which is controlled to a constant current of +10 μA, to the primary transfer roller 5*a*, to thereby primarily transfer the toner image of negative polarity borne by the photosensitive drum 1*a* onto the intermediate transfer belt 51. Transfer residual toner remaining on the photosensitive drum 1*a* after the primary transfer is removed by the cleaning device 6*a* and recovered.

The intermediate transfer belt 51 formed of an endless belt, which serves an example of the intermediate transfer member, is arranged above the photosensitive drums 1*a*, 1*b*, 1*c*, and 1*d* in a manner that the intermediate transfer belt 51 passes through the image forming portions Pa, Pb, Pc, and Pd in a slanting direction. The intermediate transfer belt 51 is supported by being looped around a drive roller 13, an opposing roller 56, and a tension roller 12, and driven by the drive roller 13 to be rotated in a direction indicated by an arrow R2 at a processing speed of 135 mm/sec. The tension roller 12 applies, using a pressurizing unit (not shown), a tensional force of 98 N in order to prevent the intermediate transfer belt 51 from slipping off the drive roller 13.

A secondary transfer roller 57 is brought into pressure-contact with the intermediate transfer belt 51 supported by the opposing roller 56, to thereby form the secondary transfer portion T2 for a toner image between the intermediate transfer belt 51 and the secondary transfer roller 57. The secondary transfer portion T2 nips and conveys the recording material P in a state where the recording material P is overlaid on the toner image formed on the intermediate transfer belt 51. A power supply D2 applies a DC voltage of positive polarity, which is controlled to a constant current of +20 μA, to the secondary transfer roller 57, to thereby secondarily transfer the toner image from the intermediate transfer belt 51 onto the recording material P.

The recording materials P pulled out from a cassette 20 are separated one by one by a separating roller 21, and supplied to a registration roller 66 in a stopped state. The registration roller 66 holds the recording material P to send out the recording material P to the secondary transfer portion T2 in timed relation to the toner image on the intermediate transfer belt 51.

The fixing device 7 subjects the full-color toner image to heat and pressure at a fixing nip portion between a fixing roller 71 and a pressure roller 72, to thereby heat-fix the toner image onto a surface of the recording material P.

<Belt Cleaning Device>

Figure 2A:
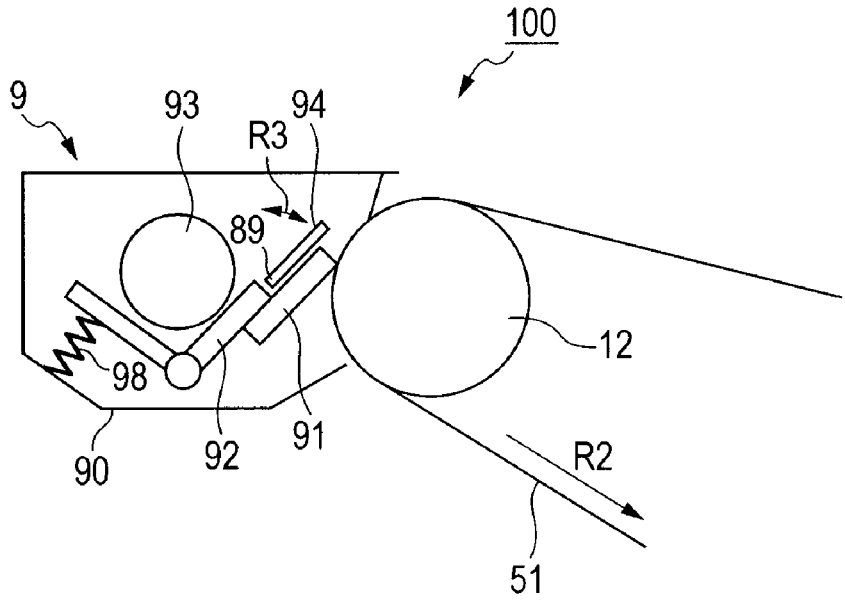
FIGS. 2A and 2B are explanatory diagrams for illustrating a configuration of a belt cleaning device.
Figure 2B:
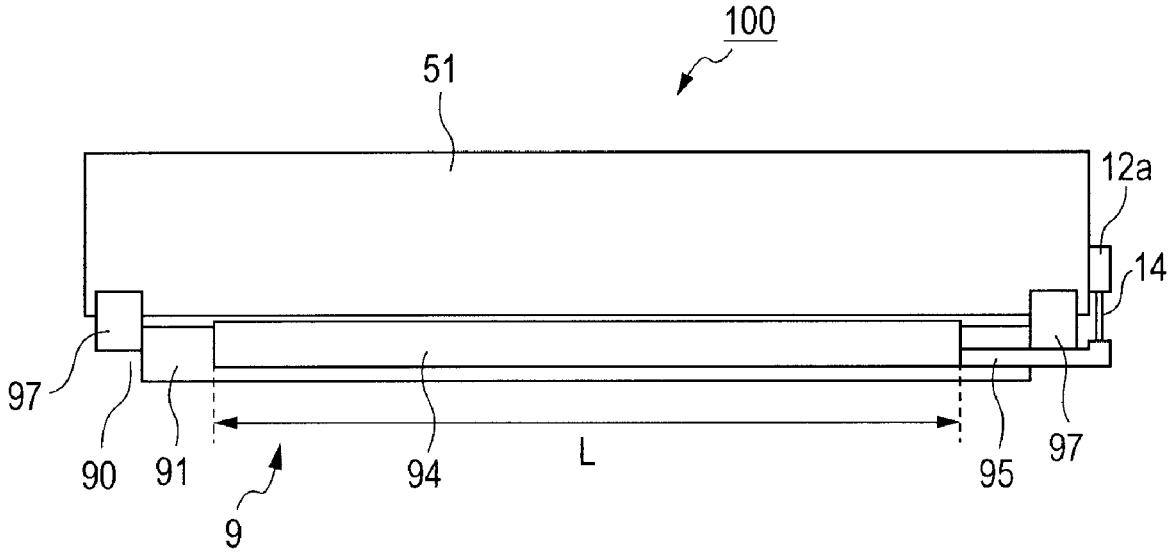
Figure 3:
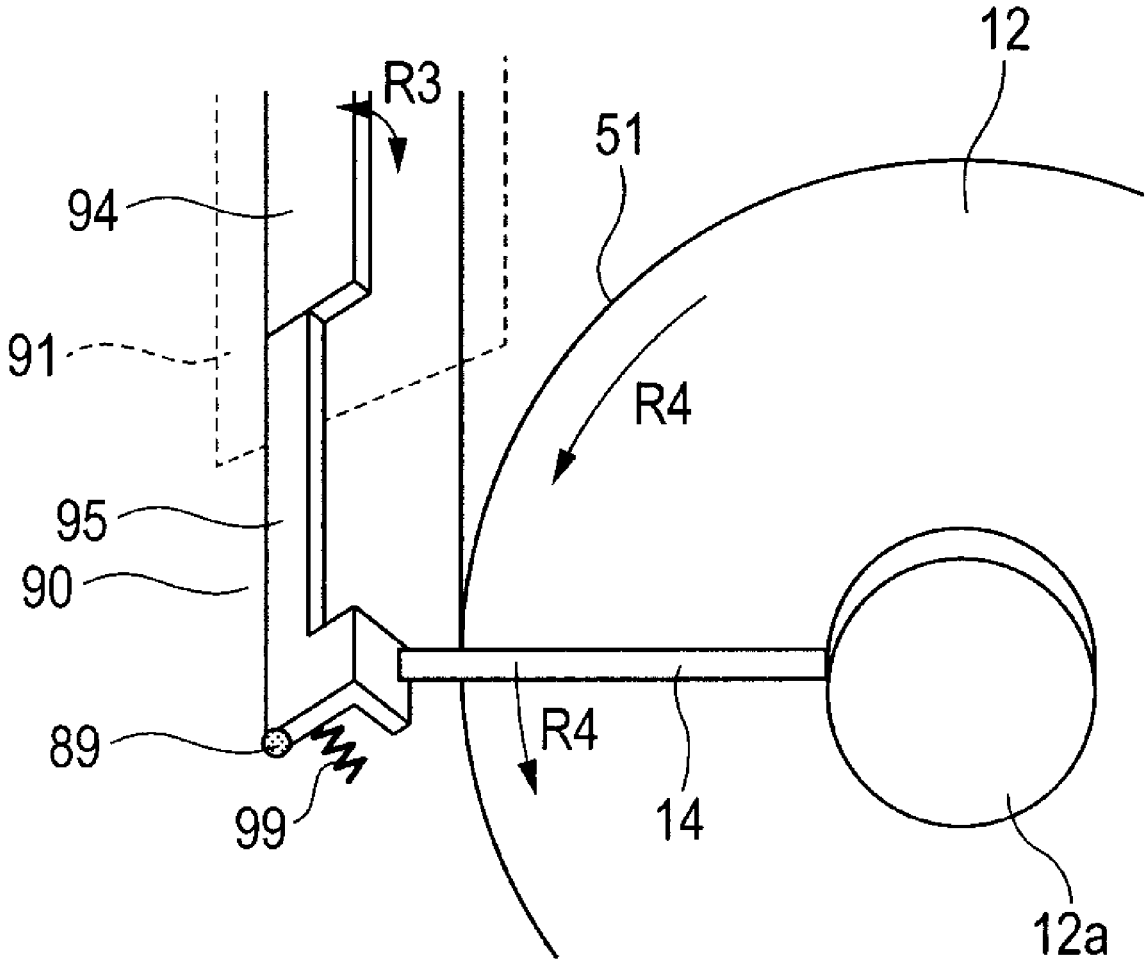
FIG. 3 is an explanatory diagram of a drive mechanism of a cleaning auxiliary member.

FIGS. 2A and 2B are explanatory diagrams for illustrating a configuration of a belt cleaning device. FIG. 3 is an explanatory diagram for illustrating a drive mechanism of the cleaning auxiliary member. FIGS. 4A, 4B, and 4C are explanatory diagrams for illustrating toner accumulation distributions on a cleaning blade in a fly toner area. FIG. 2A is a cross-sectional diagram of the belt cleaning device viewed from an axial direction. FIG. 2B is a cross-sectional diagram of the belt cleaning device viewed from above.

As illustrated in FIG. 2A, in a belt cleaning device 9, a cleaning blade 91 rubs against the intermediate transfer belt 51, to thereby clean un-transferred residual toner from the intermediate transfer belt 51 that has passed through the secondary transfer portion (T2 of FIG. 1).

The cleaning blade 91 is formed of polyurethane rubber having a Japanese Industrial Standards (JIS) Asker hardness of 70 degrees in a thickness of 2 mm, and is supported by a sheet metal portion 92.

The cleaning blade 91 is biased to the intermediate transfer belt 51 with a biasing force of a total pressure of 14 N, by a compression spring 98 provided on each of both ends of the sheet metal portion 92. In this manner, the cleaning blade 91 abuts the intermediate transfer belt 51 with a constant line pressure of 35 N/m.

A conveying screw 93 is disposed in proximity to the cleaning blade 91, and conveys the toner scraped off by the cleaning blade 91 from the intermediate transfer belt 51, toward an end on the depth side of a cleaning container 90. The end on the depth side of the cleaning container 90 is connected to a recovered toner container (a developer recovering portion) (not shown), into which the toner conveyed by the conveying screw 93 falls to be recovered.

As illustrated in FIG. 2B, end seals 97 are attached to the cleaning container 90 outside the cleaning blade 91, and abut the intermediate transfer belt 51. The end seal 97 may be formed by using a formed material, a nonwoven fabric, or a woven fabric. The end seals 97 prevent toner, which has side-slid along the distal edge of the cleaning blade 91 or has been carried by the conveying screw 93, from leaking out of the cleaning container 90.

Meanwhile, toner that has been scraped off from the intermediate transfer belt 51 accumulates on a blade surface of the cleaning blade 91. The blade surface faces upward, and hence the toner accumulated on the blade surface is difficult to guide to the conveying screw 93. In the process of delivering toner, which has been scraped off from the intermediate transfer belt 51 by the cleaning blade 91, to the conveying screw 93, the toner particles may coagulate with each other due to an electrostatic or nonelectrostatic adhesion force. As a result, the toner transporting performance of the conveying screw 93 is degraded, and there is a possibility that toner accumulates excessively in the vicinity of the cleaning blade 91. As a result, the toner may slip out through the cleaning blade 91, leading to a cleaning failure, the toner may exceed the capacity of the belt cleaning device 9 and clog, leading to a toner leakage therefrom, or an excessive load may be generated when driving the intermediate transfer belt 51. These problems may also be accounted for by the fact that the degree of freedom in the arrangement of the cleaning blade 91 is becoming lower along with the downsizing of the image forming apparatus 100 in recent years, and hence the cleaning blade 91 cannot be disposed in an optimized condition in terms of arrangement and angle capable of preventing toner from accumulating thereon.

As illustrated in FIG. 4A, without a cleaning auxiliary member 94, a large amount of toner is accumulated on the cleaning blade 91 all the way to a terminal end thereof in the longitudinal direction of the cleaning blade 91.

The length of the cleaning blade 91 is generally larger than the width of the image formable area on a surface of the intermediate transfer belt 51. Toner is mainly supplied to the image formable area, and hence a large amount of toner, which serves as a lubricant, is accumulated on a distal edge of the cleaning blade 91 in a part that lies on the image formable area, while a small amount of toner exists on a distal edge of the cleaning blade 91 in a part that lies outside the image formable area.

Toner to be supplied to the distal edge of the cleaning blade 91 in a part outside the image formable area includes fly toner generated due to instability of charging and development during image formation and side-slide toner formed of toner which is carried, after accumulating on the distal edge of the cleaning blade 91, to an area with less toner.

Toner that has accumulated on the distal edge of the cleaning blade 91 is applied with a force directed toward the cleaning blade 91, due to the rotation of the intermediate transfer belt 51. At this time, there is left a smaller amount of space for receiving the toner moving toward the cleaning blade 91, as an amount of toner accumulated on the distal edge of the cleaning blade 91 increases. Accordingly, due to a distributed force, toner tends to move in a direction parallel to the cleaning blade 91, in particular, a direction toward both ends where no toner is accumulated.

In view of the above, in the belt cleaning device 9, the cleaning auxiliary member 94, which is a plate-shaped member and disposed to be overlaid on the cleaning blade 91, is provided. The cleaning auxiliary member 94 is intermittently vibrated in directions indicated by the two-headed arrow R3, to thereby break down toner accumulated on the blade surface so that the toner is knocked off along an inclined surface thereof. The cleaning auxiliary member 94 is vibrated in a direction of contacting and separating from the cleaning blade 91, and hence toner that has built up after being scraped off by the cleaning blade 91 may be knocked off into the conveying screw 93 without coagulating the toner.

FIG. 3 illustrates the cleaning auxiliary member 94, the intermediate transfer belt 51, and an end of the tension roller 12 overviewed. In this embodiment, the cleaning auxiliary member 94 is illustrated as a conveying portion formed of a thin plate member of a resin or metal, which is used for moving toner toward the conveying screw 93. The cleaning auxiliary member 94 is attached in a pivotable manner around a pivot axis 89, and a drive receiving member 95 connected to the cleaning auxiliary member 94 is supported by a vibration spring 99 in a vibratable manner. Then, a drive member 14 attached to a rotation shaft 12*a* of the tension roller 12 flicks the drive receiving member 95 once for each revolution of the tension roller 12, to thereby cause the cleaning auxiliary member 94 to intermittently vibrate at predetermined intervals. After being flicked, the drive receiving member 95 returns to an original position so that the cleaning auxiliary member 94 pivots around the pivot axis 89. As a result, a vibration for breaking down toner is obtained. It should be noted that, in this embodiment, the cleaning auxiliary member 94 comes into contact with the cleaning blade 91, to thereby give a vibration to the cleaning blade 91.

However, in this case, it has turned out that toner accumulated on the distal edge of the cleaning blade 91 is removed too early, which hampers the movement of toner toward outside along the distal edge of the cleaning blade 91, with the result that the movement of toner becomes discontinuous.

As described above, toner serves as a lubricant, remaining to an appropriate amount in the vicinity of a contact portion between the distal edge of the cleaning blade 91 and the intermediate transfer belt 51. The lubricating action suppresses an abnormal sound due to a minute vibration occurring between the cleaning blade 91 and the surface of the intermediate transfer belt 51, a turning-up (torn-off) of the cleaning blade 91, and a heat deterioration of the distal edge of the cleaning blade 91. Accordingly, when the supply of toner becomes discontinuous at both ends of the cleaning blade 91, an operation of the cleaning blade 91 tends to become unstable, which leads to a cleaning failure.

As illustrated in FIG. 4B, in a case where the cleaning auxiliary member 94 is disposed to extend along the entire length of the cleaning blade 91, toner accumulated along the entire length of the cleaning blade 91 is broken down under vibration. In this case, the amount of toner on the cleaning blade 91 on both ends in the longitudinal direction is further reduced, with the result that the side-slide of toner hardly occurs outside the image formable area. As a result, both the ends of the cleaning blade 91 in the longitudinal direction have no toner to be used as a lubricant, and hence the abnormal sound, the turning-up, and the deterioration of the distal edge of the cleaning blade 91 tend to be caused.

In view of the above, there is proposed to additionally provide a new mechanism for causing the cleaning auxiliary member 94 to reciprocate along the cleaning blade 91 in order to forcibly lead toner to the distal edges of both ends of the cleaning blade 91. However, this mechanism complicates the structure of the belt cleaning device 9 including the cleaning auxiliary member 94, with the result that the belt cleaning device cannot be fit into the downsized cleaning container 90 and the number of components is increased.

In the following examples, the lubricating action of toner is sufficiently ensured in both ends in the longitudinal direction of the cleaning blade 91, without resorting to an additional mechanism.

Example 1

Figure 5:
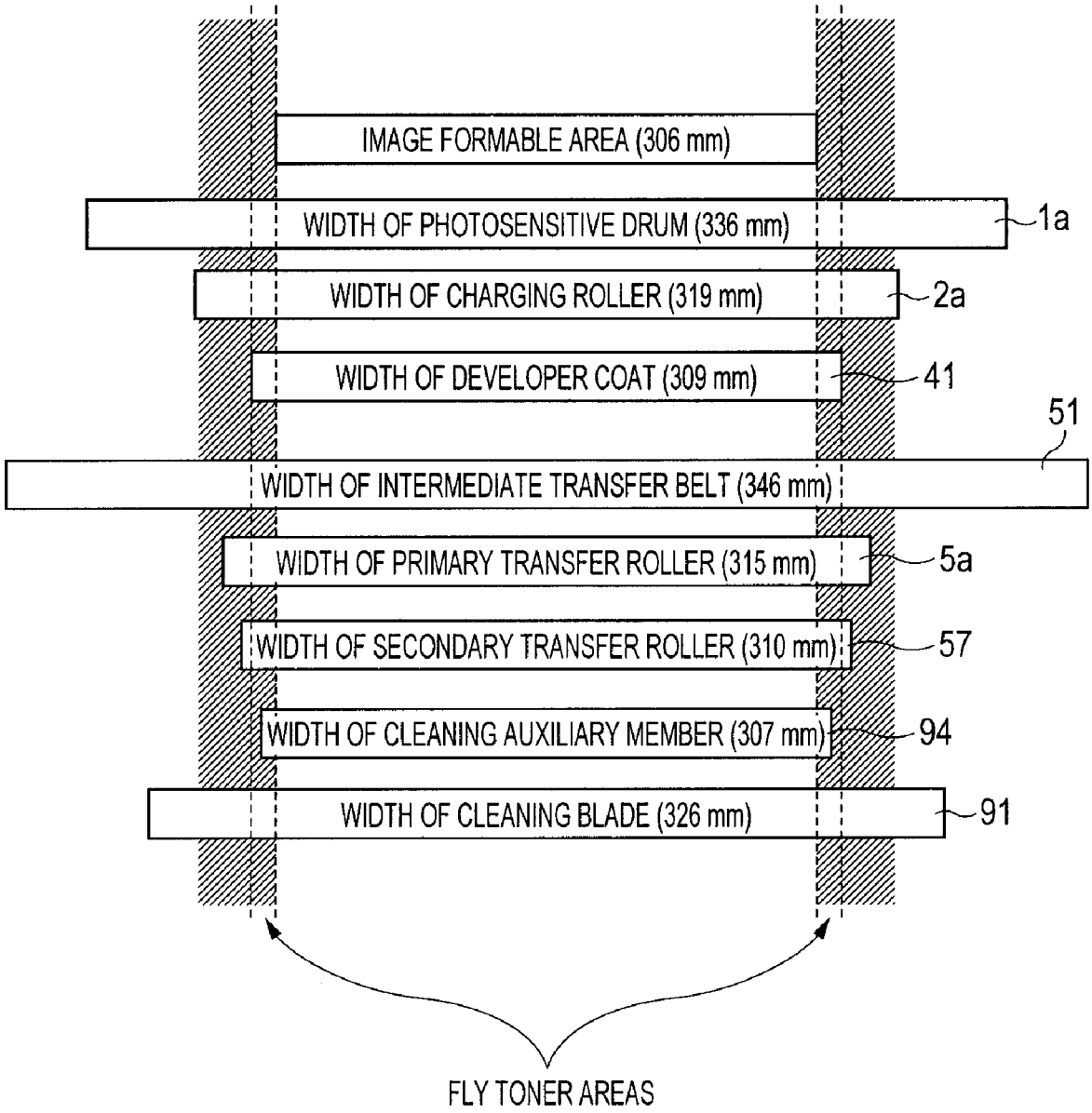
FIG. 5 is an explanatory diagram for illustrating a relation between lengths in a longitudinal direction of members of the image forming apparatus.
Figure 6A:
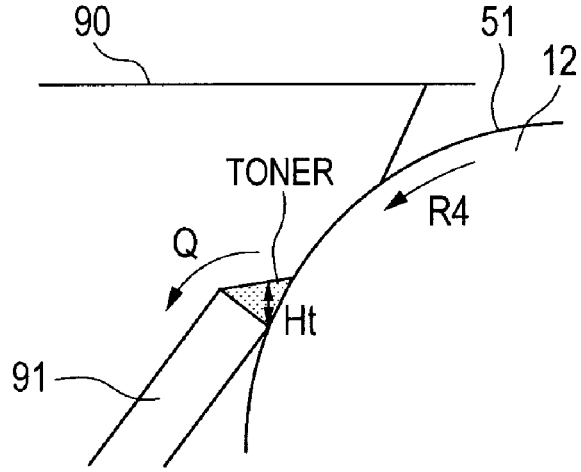
FIGS. 6A, 6B, and 6C are explanatory diagrams for illustrating an amount of toner accumulated on a distal edge of the cleaning blade.
Figure 6B:
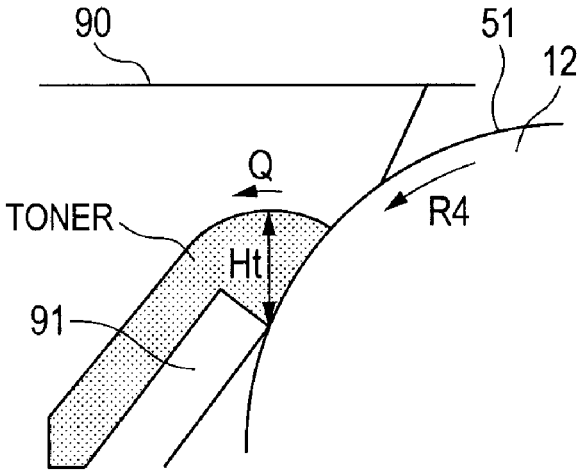
Figure 6C:
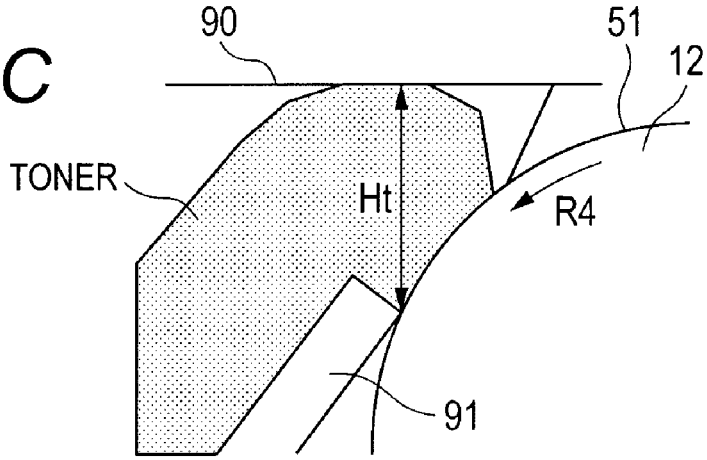

FIG. 5 is an explanatory diagram for illustrating a relation between lengths in the longitudinal direction of members of the image forming apparatus. FIGS. 6A, 6B, and 6C are explanatory diagrams for illustrating an amount of toner accumulated on the distal edge of the cleaning blade.

As illustrated in FIG. 5, in Example 1, the relation between the lengths of the cleaning blade 91 and the cleaning auxiliary member 94 is defined as follows: the width of the image formable area (306 mm)<the width of the cleaning auxiliary member (307 mm)<the width of a developer coat (309 mm)<the width of the cleaning blade (326 mm). With this configuration, the cleaning blade 91 and the cleaning auxiliary member 94 are formed substantially uniform in relation with respect to the image formable area, to thereby provide consistent and stable cleaning performance. It should be noted that, as illustrated in FIG. 2B, a length L of the cleaning auxiliary member 94 does not include the length of the drive receiving member 95 which does not have a function of breaking down toner.

The length of the cleaning blade 91 needs to be set larger than the width of the developer coat so as to cover the fly toner areas, in order to scrape off all the toner on the intermediate transfer belt (image bearing member) 51.

The fly toner areas are formed by toner that flies to the photosensitive drum 1*a* through an opening portion of the developing device 4*a* and adheres outside the image formable region. The fly toner areas have no transfer residual toner, and allow only the fly toner to be conveyed to the belt cleaning device 9. The fly toner areas are each formed on an area from the outside of the end of the width of the developer coat formed by the developer sleeve 41 to the inside of the end of the charging roller 2*a*, in which an amount of adhering toner exponentially increases to the inside from the end of the area.

A stable amount of toner adheres to each of the fly toner areas substantially irrespective of the size of the print image or the image density, and hence, if toner in the colors of cyan, magenta, yellow, and black is brought together, a sufficient amount of toner capable of forming a toner accumulation to be described later may be secured.

Accordingly, the cleaning auxiliary member 94 is configured to remove toner scraped off from the image formable area, from the cleaning blade 91, and hence the cleaning auxiliary member 94 does not cover a substantial part of each of the fly toner areas illustrated by the hatched lines, which extends beyond the ends of the width of the developer coat.

Table 1 shows a relation between a toner accumulation (height) and an operating state of the belt cleaning device 9. An experiment was carried out on the belt cleaning device 9 by supplying toner in a space between the distal edge of the cleaning blade 91 and the conveying screw 93. Then, a toner height Ht (see FIGS. 6A to 6C) on the distal edge of the end of the cleaning blade 91, the presence or absence of the side-slid of toner on a terminal end of the cleaning blade 91, and the presence or absence of the toner clogging were examined.

TABLE 1

| | Toner height Ht [mm] | | | | | |
|---|---|---|---|---|---|---|
| | 1 | 2 | 3 | 5 | 7 | 8 |
| Side-slide | absent | absent | present | present | Present | present |
| Clogging | absent | absent | absent | absent | Absent | present |

As shown in Table 1, the side-slide tends to occur as the toner accumulation increases. When the height of accumulation exceeds 3 mm, a stable side-slide is obtained, with which toner is supplied to the terminal end of the cleaning blade 91. Further, in order to suppress the turning-up or the like of the distal edge of the cleaning blade 91, the occurrence of the side-slide of toner is desired. However, when the height of accumulation exceeds 8 mm, the toner clogging tends to occur on the cleaning blade 91, and hence the toner height needs to be maintained between 3 mm and 8 mm in the belt cleaning device 9.

As illustrated in FIG. 6A, when the toner accumulation is small, the toner escapes in a direction indicated by an arrow Q, and hence the side-slide of toner in the longitudinal direction along the distal edge of the cleaning blade 91 does not occur.

However, as illustrated in FIG. 6B, as the toner accumulation on the cleaning blade 91 increases, a smaller amount of toner is allowed to escape in the direction indicated by the arrow Q due to the pressure of the accumulated toner. Then, the side-slide of toner starts to occur in the direction along the distal edge of the cleaning blade 91 in which the toner accumulation is small, that is, from the center to the outside.

However, as illustrated in FIG. 6C, when toner is accumulated on the cleaning blade 91 to the ceiling of the cleaning container 90, the toner particles coagulate with each other on the cleaning blade 91, leading to the toner clogging. As a result, the toner cannot be taken into the cleaning container 90, and the cleaning blade 91 cannot scrape off toner from the intermediate transfer belt 51 any more.

Accordingly, by stably maintaining the toner accumulation state illustrated in FIG. 6B on the cleaning blade 91 in a part outside the image formable area, the lubricating action of toner may be secured to the terminal end of the cleaning blade 91.

Table 2 shows results of comparison made by carrying out an experiment in which image formations were performed in the image forming apparatus 100 using the cleaning auxiliary member 94 in different conditions. This experiment was carried out under a condition in which sheets are continuously supplied to form full-color images having a coverage rate of 5% in an environment of high-temperature and high-humidity (30° C., 80% RH) which is prone to the toner clogging.

TABLE 2

| | Toner height Ht [mm] | | |
|---|---|---|---|
| Configuration of cleaning auxiliary member | Image formable area | Fly toner area | |
| Without cleaning auxiliary member | 8 | 5 | Toner clogging at 30,000 sheets |
| With cleaning auxiliary member (of blade width) | 3 | 2 | Abnormal sound at 60,000 sheets |

TABLE 2-continued

| | Toner height Ht [mm] | | |
|---|---|---|---|
| Configuration of cleaning auxiliary member | Image formable area | Fly toner area | |
| With cleaning auxiliary member (equal to or smaller than developer coat width) | 3 | 5 | No problem at 200,000 sheets |

As illustrated in FIG. 4A, without the cleaning auxiliary member 94, the toner height in the belt cleaning device 9 sometimes exceeded 8 mm, and the toner clogging occurred after about 30,000 sheets were supplied.

As illustrated in FIG. 4B, when the cleaning auxiliary member 94 equal in width to the cleaning blade 91 was provided, the toner height was 2 mm to 3 mm, and an abnormal sound was generated after about 60,000 sheets were supplied.

As illustrated in FIG. 4C, when the cleaning auxiliary member 94 was provided in the manner as described in Example 1, the toner height was 3 mm to 5 mm, and the abnormal sound, the turning-up of the cleaning blade, or the toner clogging was not caused.

As illustrated in FIG. 5, the cleaning auxiliary member 94 is not provided in the fly toner areas, and hence toner in the fly toner areas may be reserved to an amount sufficient enough that allows the toner to side-slide to the terminal ends of the cleaning blade 91. Due to the occurrence of the side-slide of toner, the lubricating action of the toner is stabilized, which prevents the abnormal sound, the turning-up, or the heat deterioration of the cleaning blade 91.

Further, in a case where the fly toner increases in amount, toner to be scraped off in the fly toner areas also increases in amount, which increases the toner height in the fly toner areas to be larger than the above-mentioned condition, with the result that the side-slide of toner also increases in amount. However, in a case where the toner height in the fly toner areas increases to be larger than the toner height in the image formable area, the side-slide of toner occurs in an opposite direction, that is, from each of the fly toner areas to the image formable area, and hence the toner clogging does not occur in the fly toner area. Further, even when the side-slide of toner increases in amount, the toner is blocked by the end seals 97 as illustrated in FIG. 2B, without leading to a problem of overflowing the cleaning container 90.

As illustrated in FIG. 1, in the image forming apparatus 100, the image formable areas in the image forming portions Pa, Pb, Pc, and Pd are all equal to one another in size. However, in a case where the image formable area is different in size depending on the image forming portion, the cleaning auxiliary member 94 may be configured to have a length larger than a largest image formable area, to thereby implement the present invention.

It should be noted that Example 1 employs a configuration of exclusively using toner in the fly toner areas in order to form the toner accumulation to a necessary height on the cleaning blade 91, without resorting to using toner in the image formable area. This is because, as described above, a stable amount of toner adheres to each of the fly toner areas, substantially irrespective of the size of the print image or the image density. As described above, the fly toner areas are each formed by toner that has flown through the opening portion of the developing device and adhered to the area, and hence the amount of toner adhering outside the image formable area exponentially decreases to the outside. Accordingly, toner scraped off by the cleaning blade 91 in the fly toner areas naturally forms a toner accumulation distribution which has a gradient downward to the outside, to thereby drive toner to side-slide along the distal edge of the cleaning blade 91.

In contrast, an amount of toner scraped off in the image formable area greatly varies depending on the size of the print image or the image density, and hence an accumulation of toner in a stable height cannot be secured as long as relying on the print image. Toner to be scraped off in the image formable area needs to be continuously removed immediately by using the cleaning auxiliary member 94. Otherwise, in the downsized cleaning container 90, the toner clogging may occur between the cleaning blade 91 and the ceiling of the cleaning container 90 when image formation at high densities is continuously performed.

However, a patch toner image may be periodically formed on a terminal end of the image formable area, which is exclusively used for the purpose of supplying toner to the cleaning blade 91, to thereby secure a stable amount of toner to be supplied to the cleaning blade 91 in the corresponding portion. In such an example, the cleaning auxiliary member 94 may be disposed as being further reduced in length to the center, avoiding the terminal ends of the image formable area.

Example 2, Example 3

Figure 7A:
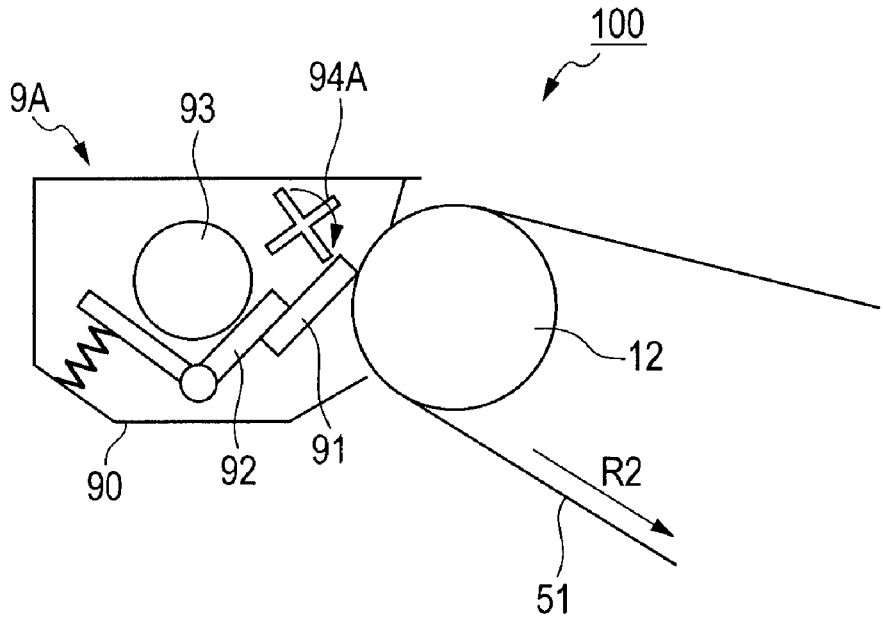
FIGS. 7A and 7B are explanatory diagrams for illustrating configurations of belt cleaning devices of Example 2 and Example 3 of the present invention, respectively.
Figure 7B:
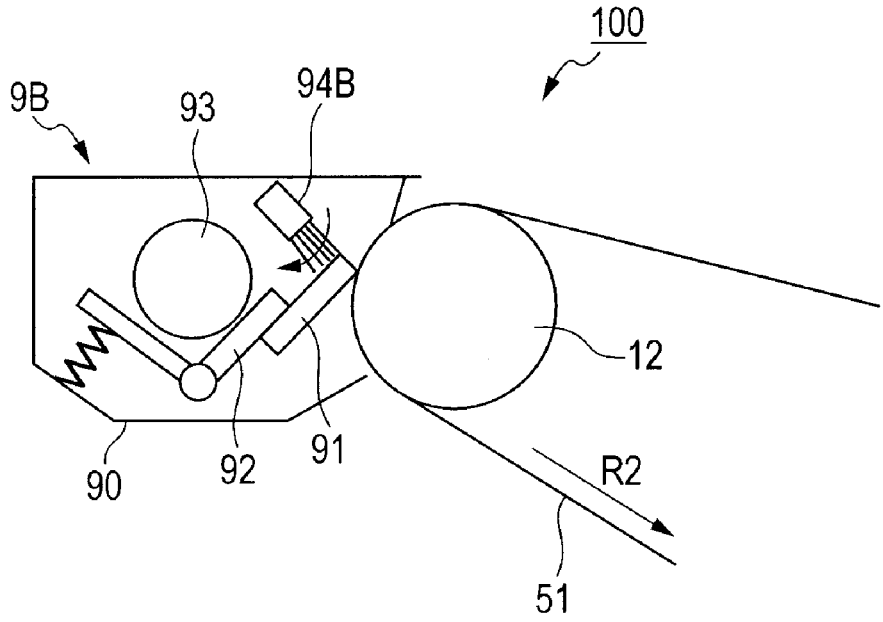

FIGS. 7A and 7B are explanatory diagrams for illustrating configurations of belt cleaning devices of Example 2 and Example 3 of the present invention, respectively.

As illustrated in FIGS. 2A and 2B, in Example 1, the cleaning auxiliary member 94 is formed of a vibrating plate-shaped member. In contrast, in Example 2, a cleaning auxiliary member 94A is formed of rotating scraper blades. The scraper blades come into contact with the cleaning blade 91. In Example 3, a cleaning auxiliary member 94B is formed of a brush member that pivots to sweep out toner. The brush member comes into contact with the cleaning blade 91. Example 2 and Example 3 are similar to Example 1 in configuration other than the cleaning auxiliary member, and hence redundant description thereof is omitted.

The image forming apparatus 100 includes the image bearing member 51, the cleaning blade 91, and a conveying member 93. Further, the cleaning blade 91 is disposed in a direction obliquely upward toward a rubbing edge on the distal edge side so that toner accumulated on the blade surface facing upward crumbles to fall off therefrom. The cleaning auxiliary member 94A, 94B crushes toner that has built up on the cleaning blade 91 so as to cause the toner to fall off into the conveying member 93.

The cleaning auxiliary member 94A, 94B is shorter than the cleaning blade 91, and disposed closer to the center so as not to interfere with the flow of toner in an outward direction on the distal edge in the end area of the cleaning blade 91. As illustrated in FIG. 5, the cleaning blade 91 is disposed so as to extend at both ends out further beyond each of the fly toner areas which are formed by toner flying outside the image formable area of a largest image. On the other hand, the cleaning auxiliary member 94A, 94B is disposed across the range of the image formable area so as to form a flow of toner toward outside in each of the fly toner areas.

Example 4

Figure 8A:
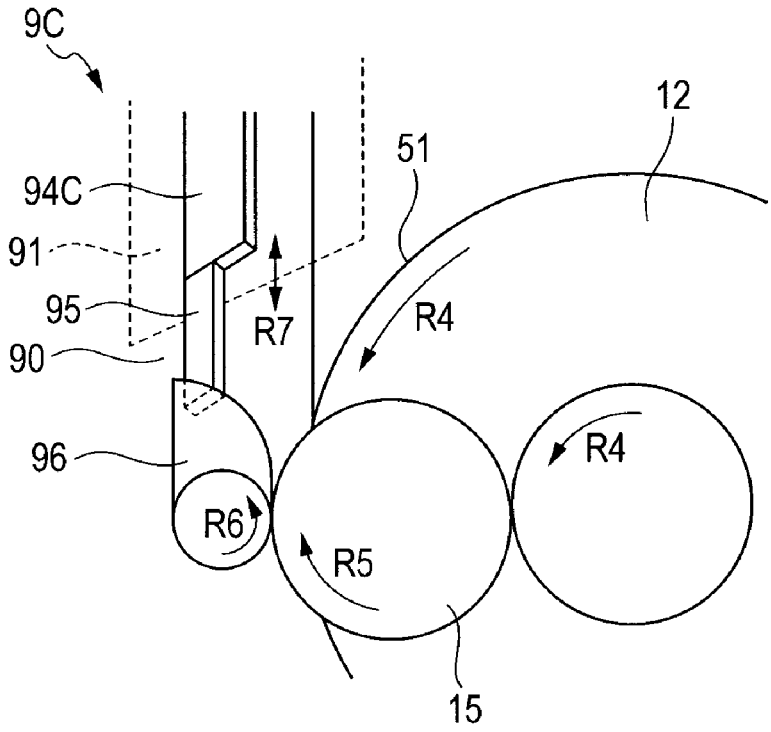
FIGS. 8A and 8B are explanatory diagrams for illustrating a pivot mechanism for a cleaning auxiliary member in a belt cleaning device of Example 4 of the present invention.
Figure 8B:
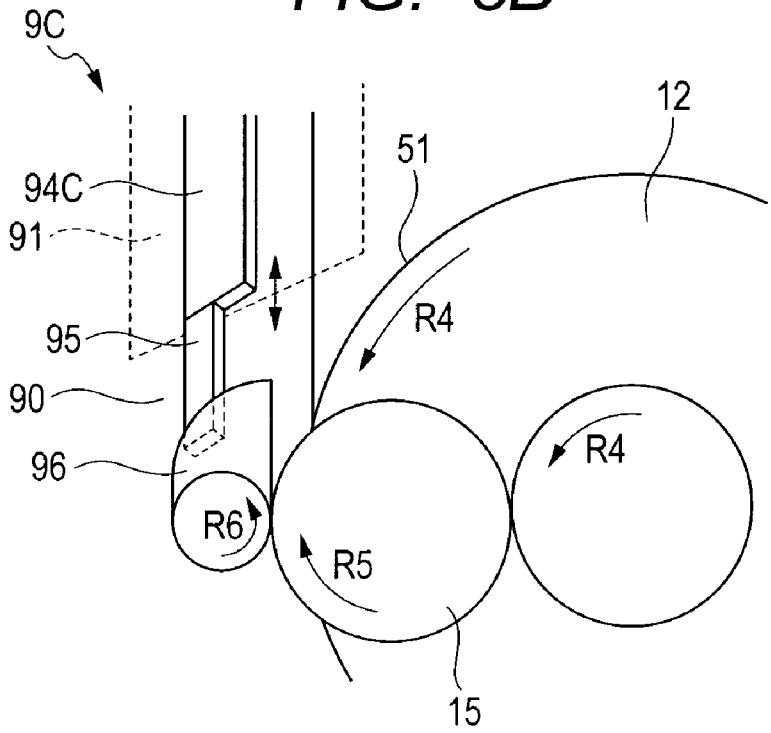
Figure 9:
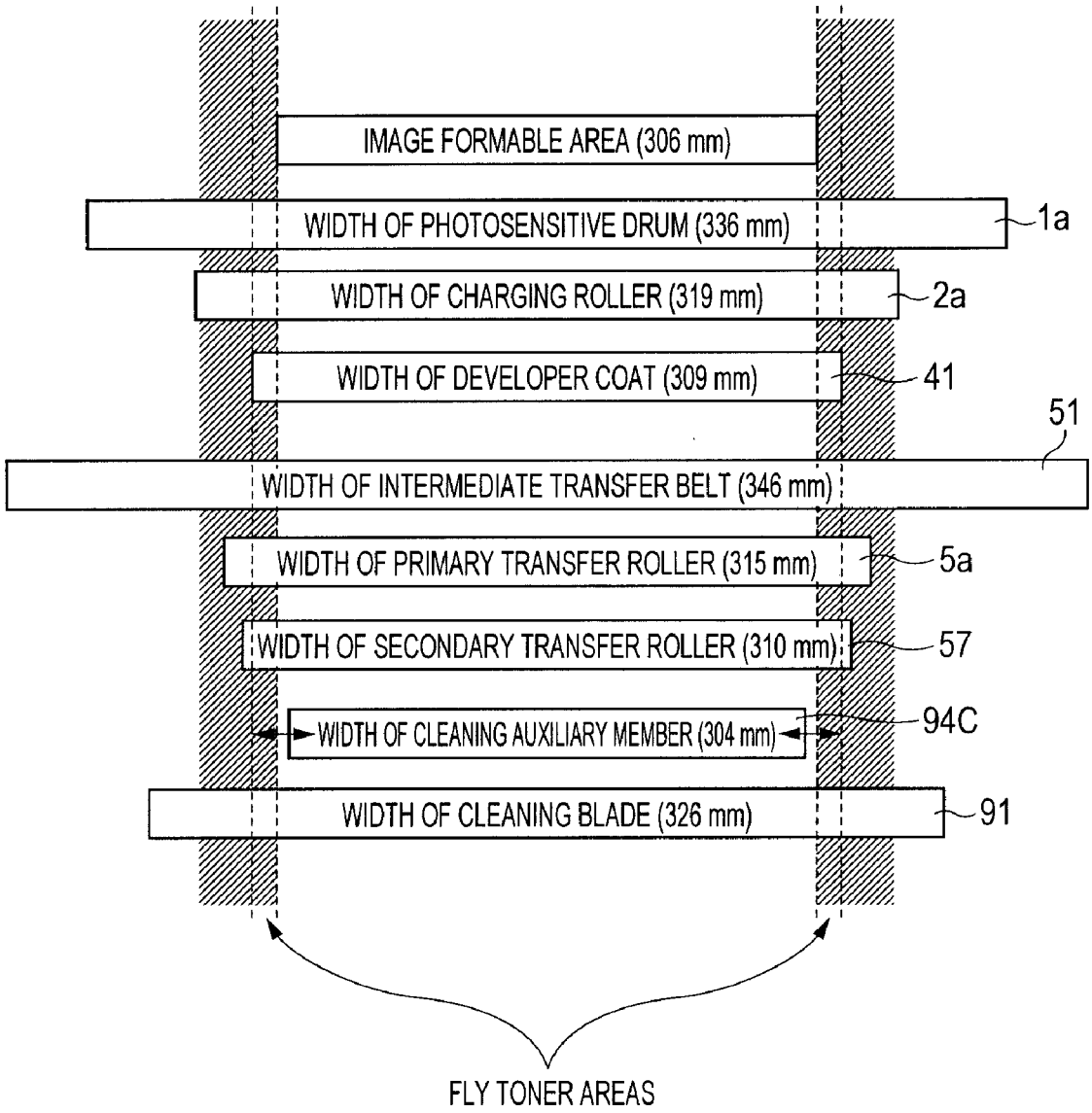
FIG. 9 is an explanatory diagram for illustrating a relation of lengths in a longitudinal direction of members of an image forming apparatus of Example 4.

FIGS. 8A and 8B are explanatory diagrams for illustrating a pivot mechanism for a cleaning auxiliary member in a belt cleaning device of Example 4 of the present invention. FIG. 9 is an explanatory diagram for illustrating a relation of lengths in a longitudinal direction of members of an image forming apparatus of Example 4.

In Example 1, the cleaning auxiliary member 94 formed of the plate-shaped member vibrates in a direction of contacting and separating from the cleaning blade 91. In contrast, in Example 4, a cleaning auxiliary member 94C formed of a plate-shaped member reciprocates in the longitudinal direction of the cleaning blade 91. Other than the difference in moving direction, Example 4 is configured similarly to Example 1 described with reference to FIG. 1 to FIGS. 6A to 6C, and hence components illustrated in FIGS. 8A, 8B, and 9 which are common to those of Example 1 are denoted by the same reference symbols as those of FIGS. 3 and 5, and redundant description thereof is omitted.

As illustrated in FIG. 8A, in a belt cleaning device 9C of Example 4, the cleaning auxiliary member 94C vibrates through the reciprocating motion in a direction parallel to the cleaning blade 91. FIGS. 8A and 8B illustrate the cleaning auxiliary member 94C, the intermediate transfer belt 51, and an end of the tension roller 12 viewed from above. The cleaning auxiliary member 94C reciprocates, to thereby break down toner that has built up after being scraped off by the cleaning blade 91 so that the toner particles may be knocked off into the conveying screw 93 before coagulating with each other.

Along with the rotation of the tension roller 12, a reciprocating gear 96 rotates through an idle gear 15. The reciprocating gear 96 is in a shape of a diagonally-cut cylinder, and the drive receiving member 95 connected to the cleaning auxiliary member 94C abuts the inclined cut surface of the reciprocating gear 96. When the reciprocating gear 96 rotates, the drive receiving member 95 moves along a thickness of the reciprocating gear 96, to thereby produce a reciprocating motion in the cleaning auxiliary member 94C. The cleaning auxiliary member 94C is changed in position from a position illustrated in FIG. 8A where the drive receiving member 95 abuts a longest portion of the reciprocating gear 96, to a position illustrated in FIG. 8B where the drive receiving member 95 abuts a shortest portion of the reciprocating gear 96. The above-mentioned operation is repeatedly performed, to thereby attain the reciprocating motion of the cleaning auxiliary member 94C for breaking down toner.

As illustrated in FIG. 9, a relation between lengths in the longitudinal direction of members of the image forming apparatus of Example 4 is established, and the length of the cleaning auxiliary member 94C is defined as follows: the image formable area (306 mm)<a reciprocating drive area of the cleaning auxiliary member (308 mm)<the width of the developer coat (309 mm)<the width of the cleaning blade (326 mm). Here, the reciprocating drive area of the cleaning auxiliary member (308 mm) is obtained as a sum of the width of the cleaning auxiliary member (304 mm) and an amplitude (±2 mm). In other words, the reciprocating drive area of the cleaning auxiliary member 94C does not cover completely the fly toner areas.

In Example 4, the image formable areas in the image forming portions Pa, Pb, Pc, and Pd are all equal to one another in size. However, in a case where the image formable area is different in size depending on the image forming portion, the cleaning auxiliary member 94C may be configured to have a length larger than a largest image formable area.

With the above-mentioned configuration, the cleaning auxiliary member 94C is not provided in the fly toner areas, similarly to Example 1, and hence toner in the fly toner areas may be reserved to an amount sufficient enough that allows the toner to side-slide, to thereby prevent the abnormal sound, the turning-up, or the deterioration of the distal edge of the cleaning blade 91.

Example 5

Figure 10:
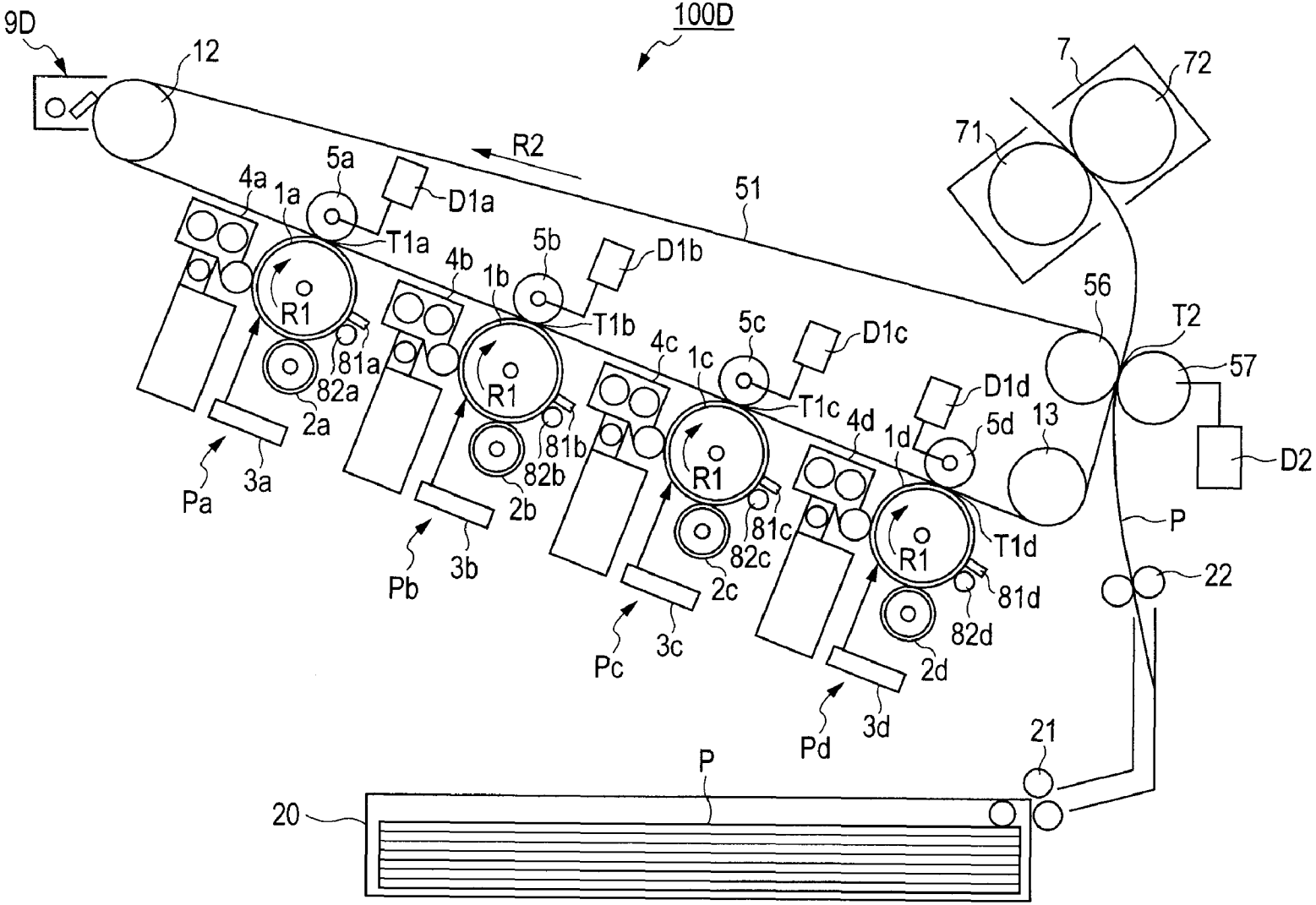
FIG. 10 is an explanatory diagram for illustrating a configuration of an image forming apparatus of Example 5 of the present invention.
Figure 11:
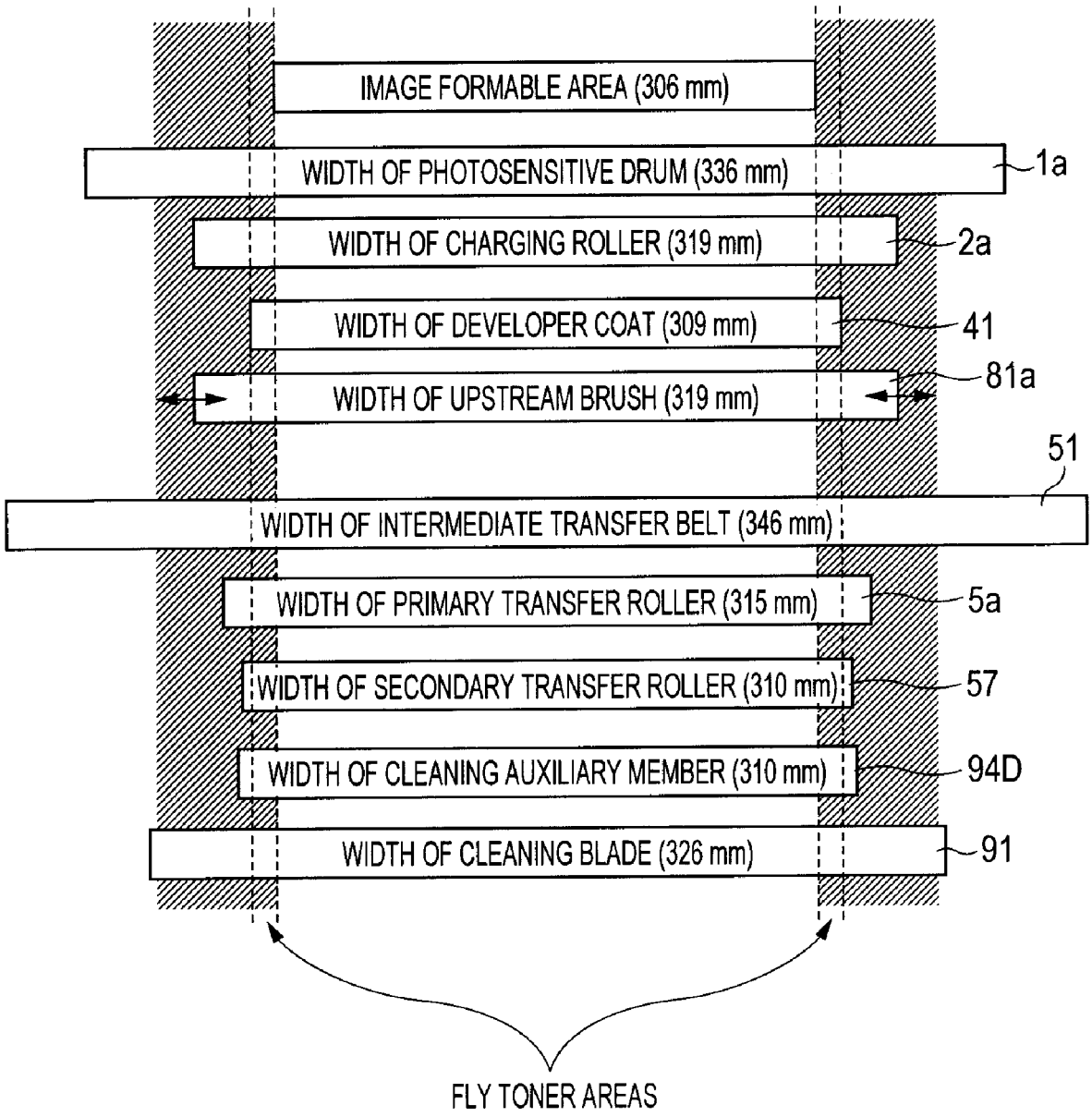
FIG. 11 is an explanatory diagram for illustrating a relation between lengths in a longitudinal direction of members of the image forming apparatus according to Example 5.

FIG. 10 is an explanatory diagram for illustrating a configuration of an image forming apparatus of Example 5 of the present invention. FIG. 11 is an explanatory diagram for illustrating a relation between lengths in the longitudinal direction of members of the image forming apparatus according to Example 5.

As illustrated in FIG. 1, in the image forming apparatus 100 of Example 1, the photosensitive drums 1*a*, 1*b*, 1*c*, and 1*d* are each provided with the cleaning devices 6*a*, 6*b*, 6*c*, and 6*d*, respectively. In contrast, in an image forming apparatus 100D of Example 5, the photosensitive drums 1*a*, 1*b*, 1*c*, and 1*d* are configured as cleaner-less systems, and not provided with the cleaning devices 6*a*, 6*b*, 6*c*, and 6*d*. Further, with consideration given to a difference in adhering state of toner on the intermediate transfer belt 51 due to the use of the cleaner-less system, the width of a cleaning auxiliary member 94D is configured to be different from that of Example 1, as illustrated in FIG. 11.

The rest of the configuration of Example 5 other than the configuration related to the cleaner-less system and the width of the cleaning auxiliary member are already described in Example 1, and hence components of FIGS. 10 and 11 which are common to those of Example 1 are denoted by the same reference symbols of FIGS. 1 and 5, and redundant description thereof is omitted.

As illustrated FIG. 10, in the image forming apparatus 100D, the photosensitive drums 1*a*, 1*b*, 1*c*, and 1*d* are not provided with the cleaning devices. Instead, upstream brushes 81*a*, 81*b*, 81*c*, and 81*d*, which serve as cleaner-less auxiliary members, and downstream brushes 82*a*, 82*b*, 82*c*, and 82*d* are provided.

In the image forming portion Pa, the upstream brush 81*a* reciprocates in the longitudinal direction as being applied with a voltage, to thereby scatter transfer residual toner. The downstream brush 82*a* rotates as being applied with a voltage so as to reverse the charging polarity of transfer residual toner to an original polarity before transfer. Specifically, the upstream brush 81*a* is applied with a vibrating voltage obtained by superimposing an AC voltage of 300 Vpp on a DC voltage of 200 V, while the downstream brush 82*a* is applied with a DC voltage of −1,000 V.

Transfer residual toner on the photosensitive drum 1*a*, which is remaining after a toner image formed on the photosensitive drum 1*a* is primarily transferred onto the intermediate transfer belt 51, is scattered by the upstream brush 81*a* reciprocating in the longitudinal direction on the photosensitive drum 1*a* and charged once to a positive polarity. After that, the transfer residual toner is recharged by the downstream brush 82*a* to a negative polarity, which may be used for developing in the developing device 4*a*, or may be recovered by the developing sleeve 41.

A relation of lengths in the longitudinal direction of members of the image forming apparatus 100D of Example 5 is established as illustrated in FIG. 11, and the length of the cleaning auxiliary member 94D is defined as follows: the image formable area (306 mm)<the width of the cleaning auxiliary member (310 mm)<the reciprocating drive area of the cleaner-less auxiliary member (323 mm)<the width of the cleaning blade (326 mm). Here, the reciprocating drive area of the cleaner-less auxiliary member (323 mm) is obtained as a sum of the width of the cleaner-less auxiliary member (319 mm) and an amplitude (±2 mm).

Specifically, the cleaning auxiliary member 94D does not cover completely the fly toner areas illustrated by the hatched lines of FIG. 11, each of which extends beyond the end of the upstream brush 81*a* (cleaner-less auxiliary member). Further, the length of the cleaning blade 91 is configured to be larger than the reciprocating drive area of the cleaner-less auxiliary member (319 mm) to cover the fly toner areas, to thereby scrape off all the toner on the intermediate transfer belt 51.

In Example 5, the image formable areas in the image forming portions Pa, Pb, Pc, and Pd are all equal to one another in size. However, in a case where the image formable area is different in size depending on the image forming portion, the cleaning auxiliary member 94D may be configured to have a length larger than a largest image formable area.

Table 3 shows results of comparison made by carrying out an experiment in which image formation was performed in the image forming apparatus 100D of Example 5 using the cleaning auxiliary member 94D in different conditions. This experiment was carried out under a condition in which sheets are continuously passed through for a full-color image with a coverage rate of 5% in an environment of high-temperature and high-humidity (30° C., 80% RH) which is prone to the toner clogging.

TABLE 3

| Configuration of cleaning auxiliary member | Toner height Ht [mm] Image formable area | Fly toner area | |
|---|---|---|---|
| Without cleaning auxiliary member | 8 | 7 | Toner clogging at 30,000 sheets |
| With cleaning auxiliary member (of blade width) | 3 | 2 | Abnormal sound at 60,000 sheets |
| With cleaning auxiliary member (equal to or smaller than developer coat width) | 3 | 7 | No problem at 200,000 sheets |
| With cleaning auxiliary member (equal to or larger than developer coat width and equal to or smaller than cleaner-less auxiliary member width) | 3 | 5 | No problem at 200,000 sheets |

As shown in Table 3, without the cleaning auxiliary member 94D, the toner height in a belt cleaning device 9D sometimes exceeded 8 mm, and the toner clogging occurred after about 30,000 sheets were supplied.

On the other hand, when the cleaning auxiliary member 94D equal in width to the cleaning blade was provided, the toner height was 2 mm to 3 mm, and an abnormal sound was generated after about 60,000 sheets were supplied.

In a case where the cleaning auxiliary member 94D was similarly configured as in Example 1 in which the cleaning auxiliary member 94 was configured as illustrated in FIG. 5, the toner height was 7 mm in each of the fly toner areas, and the abnormal sound, the turning-up, or the toner clogging did not occur. However, as compared to Example 1, the toner height was larger.

In Example 5, the photosensitive member 1*a* is configured as a cleaner-less system, and provided with the agitating member 81*a* which reciprocates in the longitudinal direction of the photosensitive member 1*a*, to thereby agitate toner adhering to the image formable area.

The cleaning auxiliary member 94D is larger in length than the cleaning auxiliary member 94 of Example 1. However, ranges in which the ends of the agitating member 81*a* reciprocate are set outside the positions to which the ends of the cleaning auxiliary member 94 reach.

Even in the configuration of Example 5, the toner height on the cleaning blade 91 in each of the fly toner areas was 3 mm to 5 mm, and the abnormal sound, the turning-up, or the toner clogging did not occur. In the configuration of Example 5, as compared to the configuration of Example 1, due to the reciprocating motion of the upstream brush 81*a*, the fly toner areas are extended. Accordingly, even when the width of the cleaning auxiliary member 94D is increased to be larger than the width of the developer coat, toner may be caused to accumulate to an appropriate height on the ends of the blade as long as the width of the cleaning auxiliary member 94D is reduced to be smaller than the width of the cleaner-less auxiliary member 81*a*.

In other words, the width of the cleaning auxiliary member 94D is defined with reference to the width of the cleaner-less auxiliary member 81*a*, to thereby prevent the toner clogging, the abnormal sound, the turning-up, and the deterioration of the distal edge from occurring.

Example 6

The description given above is similarly applied to a cleaner device for cleaning various members, such as a photosensitive drum, an intermediate transfer member, or a transfer roller, on which an image is formed with toner.

According to Examples described above, the cleaning blade may be stably supplied with toner as a lubricant on both ends thereof. In the cleaning device which includes the cleaning auxiliary member for breaking down toner accumulated in the vicinity of the cleaning blade, toner may be reliably built up even in the end portions of the cleaning blade.

Toner accumulated in the end portions of the cleaning blade is not broken down, and hence the toner flows to the terminal ends of the cleaning blade, to thereby reliably build up on the distal edges on the terminal ends of the blade. In this manner, even in a configuration which is improved in ability to transfer toner after cleaning to a recovery container, the abnormal sound, the turning-up, and the deterioration of the cleaning blade at the terminal ends thereof may be prevented.

As described above, according to the present invention, the cleaning auxiliary member breaks down toner built up on the cleaning blade to knock off the toner into the conveying member in a manner that toner accumulated on an area adjacent to the end area of the cleaning blade is left unremoved. The toner scraped off to be accumulated is developed on the unremoved area, to thereby function a mechanism in which toner that flows along the distal edge of the cleaning blade is driven by the gradient of the accumulation distribution to diffusely move outward. In order to stably attain the toner accumulation as described above in the end area, the cleaning auxiliary member is configured to be shorter than the cleaning blade and disposed closer to the center with respect to the cleaning blade. With this configuration, a stable flow of toner is formed in a direction of flattening the distribution of accumulated toner, which provides continuous supply of toner to the distal edges of the terminal ends of the cleaning blade.

Accordingly, even when a configuration of assisting the movement of toner from the cleaning blade to the conveying member is provided, toner is still sufficiently supplied to the cleaning blade outside the image formable area, to thereby allow the cleaning blade to provide stable cleaning performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-243172, filed Oct. 22, 2009, which is hereby incorporated by reference herein in its entirety.

What is claimed is:

1. An image forming apparatus, comprising:

a rotatable image bearing member;

a developer carrying member configured to carry a developer to form a developer image on the image bearing member;

a cleaning blade configured to remove the developer remaining on the image bearing member;

a conveying unit configured to convey the developer removed by the cleaning blade, toward a developer recovering portion; and a cleaning auxiliary portion configured to move the developer accumulated on the cleaning blade toward the conveying unit, the cleaning auxiliary portion having a length that is smaller, in a rotation axial direction of the image bearing member, than a developer width of the developer carried by the developer carrying member.

2. An image forming apparatus according to claim 1, wherein the developer width is larger than a width of an image formable area in the rotation axial direction.

3. An image forming apparatus according to claim 2, wherein the length of the cleaning auxiliary portion is larger, in the rotation axial direction, than the width of the image formable area.

4. An image forming apparatus according to claim 1, wherein the cleaning auxiliary portion produces a reciprocating motion in the rotation axial direction and the reciprocating motion is produced so that both ends of the cleaning auxiliary portion fall within a range not exceeding the developer width.

5. An image forming apparatus according to claim 1, further comprising a charging member configured to charge the image bearing member, wherein both ends of a charging area charged by the charging member in the rotation axial direction are located outside both ends of the developer width.

6. An image forming apparatus according to claim 1, wherein the cleaning auxiliary portion comprises a plate-shaped member disposed to be overlaid on a surface of the cleaning blade, and intermittently vibrates in a direction of contacting and separating from the cleaning blade.

7. An image forming apparatus according to claim 1, wherein the cleaning auxiliary portion comprises a brush member that rotates, and reciprocates in the rotation axial direction with an amplitude small enough to prevent both ends of the brush member from extending out beyond both ends of the cleaning blade in the rotation axial direction.

8. An image forming apparatus, comprising:

a rotatable image bearing member;

a developer carrying member configured to carry a developer to form a developer image on the image bearing member;

a belt member configured to retain the developer image formed on the image bearing member, the developer image being transferred onto the belt member;

a cleaning blade configured to remove the developer remaining on the belt member;

a conveying unit configured to convey the developer removed by the cleaning blade, toward a developer recovering portion; and a cleaning auxiliary portion configured to move the developer accumulated on the cleaning blade toward the conveying unit, the cleaning auxiliary portion having a length that is smaller, in a rotation axial direction of the image bearing member, than a developer width of the developer carried by the developer carrying member.

9. An image forming apparatus according to claim 8, wherein the developer width is larger than a width of an image formable area in the rotation axial direction.

10. An image forming apparatus according to claim 9, wherein the length of the cleaning auxiliary portion is larger, in the rotation axial direction, than the width of the image formable area.

11. An image forming apparatus according to claim 8, wherein the cleaning auxiliary portion produces a reciprocating motion in the rotation axial direction and the reciprocating motion is produced so that both ends of the cleaning auxiliary portion fall within a range not exceeding the developer width.

12. An image forming apparatus according to claim 8, further comprising a charging member configured to charge the image bearing member, wherein both ends of a charging area charged by the charging member in the rotation axial direction are located outside both ends of the developer width.

13. An image forming apparatus according to claim 8, wherein the cleaning auxiliary portion comprises a plate-shaped member disposed to be overlaid on a surface of the cleaning blade, and intermittently vibrates in a direction of contacting and separating from the cleaning blade.

14. An image forming apparatus according to claim 8, wherein the cleaning auxiliary portion comprises a brush member that rotates, and reciprocates in the rotation axial direction with an amplitude small enough to prevent both ends of the brush member from extending out beyond both ends of the cleaning blade in the rotation axial direction.

* * * * *